US005265569A

United States Patent [19]

Egashira et al.

[11] Patent Number: 5,265,569

[45] Date of Patent: Nov. 30, 1993

[54] PRIME MOVER ROTATIONAL SPEED CONTROL SYSTEM

[75] Inventors: Masaki Egashira; Masakazu Haga, both of Ibaraki; Osamu Tomikawa, Tsuchiura; Touichi Hirata, Ushiku, all of Japan

[73] Assignee: Hitachi Construction Machinery Co., Ltd., Tokyo, Japan

[21] Appl. No.: 847,034

[22] PCT Filed: Sep. 27, 1991

[86] PCT No.: PCT/JP91/01299

§ 371 Date: Apr. 16, 1992

§ 102(e) Date: Apr. 16, 1992

[87] PCT Pub. No.: WO92/06287

PCT Pub. Date: Apr. 16, 1992

[30] Foreign Application Priority Data

Sep. 28, 1990 [JP] Japan ..... 2-259966

[51] Int. Cl.[5] ..... F02D 31/00

[52] U.S. Cl. ..... 123/357; 123/373

[58] Field of Search ..... 123/357, 358, 359, 494, 123/373

[56] References Cited

U.S. PATENT DOCUMENTS

| | | | |
|---|---|---|---|
| 3,699,935 | 10/1972 | Adler | 123/358 |
| 4,177,516 | 12/1979 | Mason | 123/358 |
| 4,321,901 | 3/1982 | Robayashi | 123/357 |
| 4,474,156 | 10/1984 | Brotherston | 123/373 |
| 4,502,438 | 3/1985 | Yasuhara | 123/357 |
| 4,616,616 | 10/1986 | Staniak | 123/373 |
| 4,669,436 | 6/1987 | Nanjyo | 123/357 |
| 4,729,357 | 3/1988 | Freudenschuss | 123/357 |
| 4,823,751 | 4/1989 | Pfalzgraf | 123/357 |
| 4,836,166 | 6/1989 | Wietelmann | 123/358 |
| 4,955,344 | 9/1990 | Tatsumi | 123/357 |

*Primary Examiner*—Carl S. Miller

*Attorney, Agent, or Firm*—Antonelli, Terry, Stout & Kraus

[57] ABSTRACT

A rotational speed control system for controlling the number of revolutions of an engine through remote control of rotation of a governor lever. This rotational speed control system includes a stepping motor for rotating the governor lever, lever position sensor switches for detecting abutment of the governor lever against stoppers, respectively, a pulse counter, and a controller. The controller is adapted to store a count value of the pulse counter as a renewable reference value when the position sensor switches are turned on, to carry out the rotational speed control of the engine and necessary preadjustments according the reference value.

2 Claims, 11 Drawing Sheets

PRIME MOVER ROTATIONAL SPEED CONTROL SYSTEM

FIELD OF THE INVENTION

This invention relates to a system for controlling rotational speed of a prime mover particularly suitable for use on a construction machine such as hydraulic power shovel or the like for controlling rotational speed of the prime mover.

BACKGROUND OF THE INVENTION

Generally, a Diesel engine is mounted on construction machines to serve as a prime mover for driving hydraulic pumps.

In this regard, it has been the general practice for conventional construction machines of this to provide a control lever in an operator's cabin and to link the control lever with a governor mechanism of the engine through a controlling cable, link rod and so forth for control the rotational speed of the engine. However, the mechanical linkage of the control lever with the governor mechanism through the control cable and link rod has a drawback that it requires large operating forces.

With a view to eliminating such a drawback, there has been proposed an electric remote control system for governor mechanism, including an electric motor provided in the vicinity of an engine for governor adjustment, a rotational angle sensor adapted to detect the rotational angle of the governor mechanism indicative of the rotational speed of the engine, and a command means in the form of operating switches or the like provided in the operator's cabin in association with a controller such as microcomputer. The controller is adapted to control the electric motor through feedback control in such a manner so as to make the difference between a signal value specified by the command means and a signal value detected by the rotational angle sensor zero, thereby turning the governor lever of the governor mechanism to a position corresponding to the specified value.

In this connection, FIGS. 11 to 13 show, by way of example a construction machine employing a prior art prime mover rotational speed control system with a governor mechanism of the type mentioned above.

In FIGS. 11–13, a Diesel engine 1 is mounted on a construction machine as a prime mover with governor 2 being provided on the engine 1. The governor 2 includes an elongated governor lever 3 and stoppers 4 and 5 for limiting the rotational range of the governor lever 3 by abutting engagement therewith. The governor 2 functions to adjust the rotational speed of the engine 1 according to the rotational angle of the governor lever 3 in an accelerating direction H or decelerating direction L, and, as shown in FIG. 12, to hold the engine at the lowest speed $N_L$ (idling speed) when the governor lever 3 abuts against the stopper 4 where the value of lever rotation is 0%, while holding the engine at the maximum speed $N_H$ (full speed) when the governor lever 3 abuts against the stopper 5 where the value of lever rotation is 100%.

A reversible stepping motor is mounted in the vicinity of the engine 1. A lever 6A is mounted on the output shaft of the stepping motor 6 and is connected to the governor lever 3 through a link 7. The stepping motor 6 is rotatable in a forward direction F or in a reverse direction R in dependence upon a control pulse signal from a controller 10, which will be described hereinbelow to thereby rotate the governor lever 3 in the accelerating direction H or in the decelerating direction L through the link 7. Even when the rotation of the governor level is stopped by a stop signal received from the controller 10, the governor lever 3 is retained in the current angular position to operate the engine 1 at the current rotational speed.

A potentiometer 8 is provided in the vicinity of the engine 1 to serve as a rotational angle sensor. A lever 8A is mounted on a rotational shaft of the potentiometer 8 and is connected to the link 7. The potentiometer 8 is preadjusted such that its detection range (output range) is held in a predetermined relationship with the rotational range of the governor lever 3 as indicated by solid line in FIG. 12. The potentiometer 8 is adapted to detect the rotational angle of the governor lever 3 through the lever 8A and link 7 to produce an output signal indicative of the rotational speed of the engine 1 for supply to the controller 10.

An up-down switch is provided in the operator's cabin of the construction machine as a command means for specifying a target engine speed. The up-down switch 9 is a push-button type up-switch and down-switch (not shown). The up-down switch 9 is adapted to supply the controller 10 with a command signal, namely, an acceleration command signal or a deceleration command signal corresponding to the extent of the depressive operation on the up- or down-switch 9. According to the received command signal, the controller 10 sets up a target value M which corresponds to the target rotational speed of the engine 1 as will be described hereinbelow.

The controller 10 includes arithmetic operation circuit like CPU and a memory circuit such as ROM and RAM (not shown) as well as a memory area 10A in the memory circuit. For setting up a target value M which corresponds to the target rotational speed of the engine 1, the controller 10 is adapted to convert the command signal from the up-down switch 9 into a percentage target value M as shown in the graphical illustration of FIG. 13, which is stored in the memory area 10A, and to store the target value M thus obtained. Then, the controller 10 compares the target value M with a value $N_B$ of governor lever rotation, which is detected by the potentiometer 8 and corresponds to the rotational speed of the engine 1, to produce a control pulse signal to the stepping motor 6. Accordingly, the stepping motor 6 rotates the governor lever 3 in the accelerating direction H or decelerating direction L to control the rotational speed of the engine 1 to the target value.

With a prime mover rotational speed control system of the above-described prior art construction, the operator enters a desired engine speed through the up-down switch 9, whereupon the controller sets up a target value M of the engine speed according to the command signal from the up-down switch 9. Then, the controller 10 reads in the rotational angle of the governor lever 3 from the potentiometer 8 as a value corresponding to the current rotational speed of the engine 1, comparing the value with the target value M to produce a control pulse signal to be applied to the stepping motor 6 for rotation in the forward or reverse direction. As a result, the governor lever 3 is turned in the accelerating direction H or decelerating direction L to adjust the engine speed in accordance with the target value M.

As soon as the rotational speed of the engine 1 substantially reaches the target value M, the controller 10 produces a stop signal as a control pulse signal for the stepping motor 6, which then maintains the governor lever 3 at the current rotational angle to enable the engine 1 rotate at a speed corresponding to the target value M.

In this regard, the above-mentioned prior art is arranged to compare the target value M with a value $N_B$ of governor lever rotation, which is detected by the potentiometer 8 as an indicator of the rotational speed of the engine 1, and to adjust the rotation of the stepping motor 6 for control of the rotational speed of the engine 1. It follows that, in the entire rotational range between the minimum and maximum rotational speeds which are delimited by the stoppers 4 and 5, the governor lever 3 must be turned in a manner which corresponds to the detection range of the potentiometer 8 as indicated by solid line in FIG. 12.

However, in the above-described prior art, the positions of the stoppers 4 and 5 differ from engine to engine, so that it becomes necessary to preadjust the range between these members by changing the setting of the link ratio or through fine adjustment of the potentiometer 8 individually for each engine. These preadjustments are very troublesome and time consuming. Besides, there is a problem that the governor lever 3 and link 7 are susceptible to loosening of mechanical parts as a result of repeated operations over a long period of time, or a problem that temperature variations might cause variations in output characteristics of the potentiometer 8, resulting in a difference between the rotational range of the governor lever 3 and the detection range of the potentiometer 8, for example, as indicated by broken line in FIG. 12 to make correct control of the engine speed difficult. Furthermore, there are possibilities of noises creeping into the detection signal from the potentiometer to lower the accuracy and reliability of the engine speed control.

SUMMARY OF THE INVENTION

In view of the foregoing problems of the prior art, the present invention has as its object the provision of a prime mover rotational speed control system, which is arranged to facilitate the preadjustments to a marked degree by using a stepping motor in combination with a pulse counter means and which possesses improved reliability in stably and accurately controlling the rotational speed of a prime mover at a target value over a long period of time.

In accordance with the present invention, there is provided, for achieving the above-stated objective, a prime mover rotational speed control system, including a prime mover, with a governor having a governor lever to increase or reduce the rotational speed of the prime mover according to the rotational angle of the governor lever. A stepping motor is adapted to turn the governor lever in accordance with a control pulse signal, and a command means specifies a target rotational speed of the prime mover. A controller is adapted to produce a control pulse signal according to the specified value from the command means for application to the stepping motor. The rotational speed control system comprises a pulse counter means for counting control signal pulses to be applied to the stepping motor with the controller comprising a memory means adapted to store a count value from the pulse counter means as a renewable reference value when the rotational speed of the prime mover is set at least at one of predetermined minimum and maximum speeds thereof. An arithmetic operating means is adapted to calculate the current rotational speed of the prime mover on the basis of the reference value stored in the memory means and a count value of the pulse counter means at the current position of the governor lever.

Preferably, the above-mentioned memory means is arranged to store a count value from the pulse counter means as a renewable minimum or maximum speed reference value when the rotational speed of the prime mover is set at the minimum or maximum speed, and the arithmetic operation means is arranged to calculate the current rotational speed of the prime mover on the basis of the stored reference value and the count value of the pulse counter means at the current position of the governor lever.

With the above-described arrangement, when the rotational speed of the prime mover is set at least at the minimum or maximum speed by the command means, the governor lever is turned according to the specified rotational speed, while the memory means stores a count value from the pulse counter means, corresponding to the rotational angle of the governor lever, as a renewable reference value at the minimum or maximum speed, so that the arithmetic operating means can calculate the value of governor lever rotation corresponding to the current rotational speed of the prime mover on the basis of a current count value of the pulse counter means and the stored reference value.

Further, in an arrangement where the count values of the pulse counter means at both of the minimum and maximum speeds of the prime mover are stored in the memory means as renewable minimum and maximum reference values, the arithmetic operating means can calculate the rotational value of the governor lever corresponding to the current rotational speed of the engine, on the basis of the reference values and a current count value from the pulse counter means.

DETAILED DESCRIPTION

Figure 1:
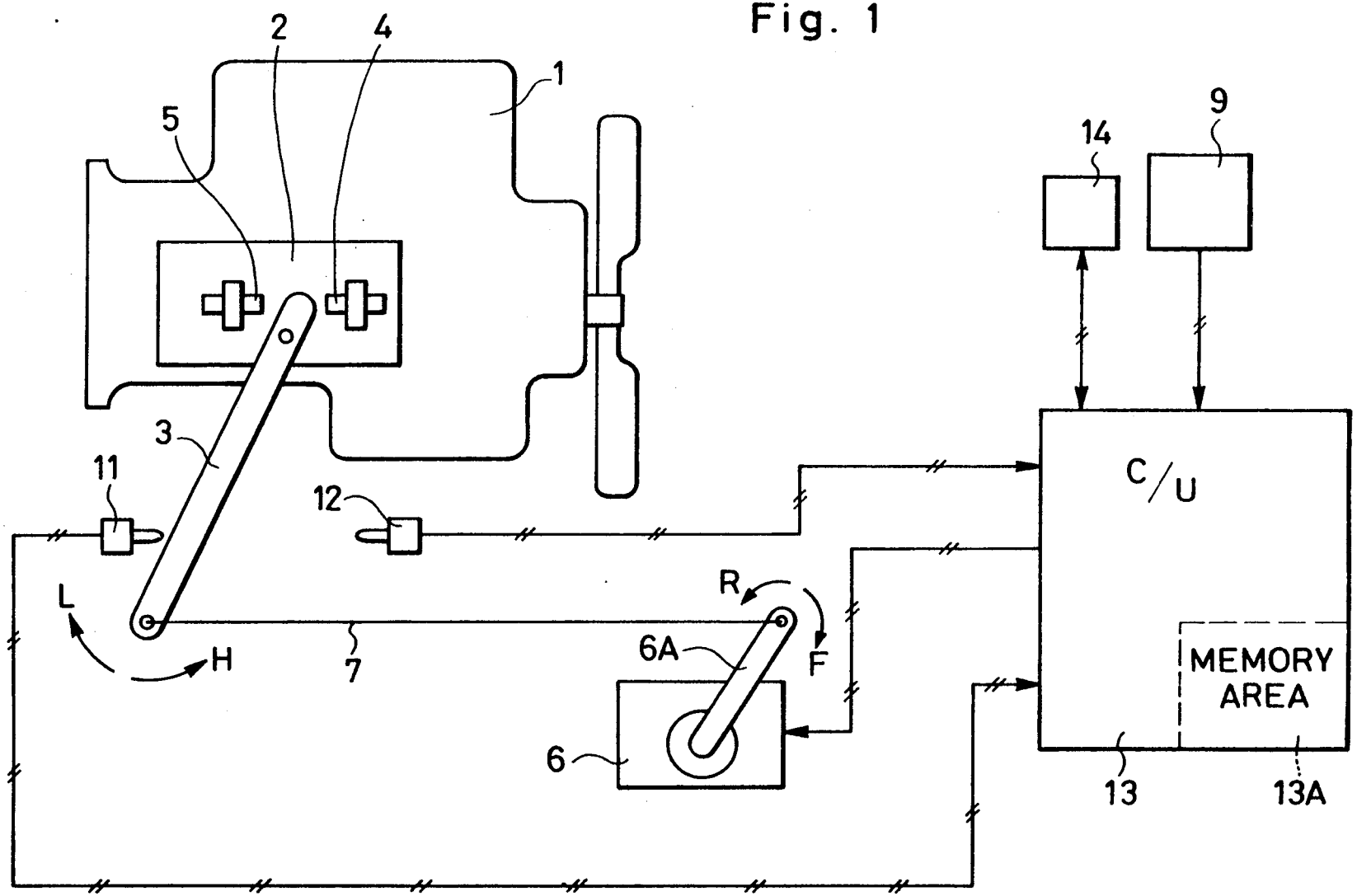
FIG. 1 is a schematic view of a prime mover rotational speed control system of a first embodiment of the present invention.

Hereafter, with reference to FIGS. 1 through 10, the invention is described by way of some exemplary embodiments in which the invention is applied to a construction machine prime mover. In the following description of the embodiments the same reference numerals are used to designate like parts.

Figure 2:
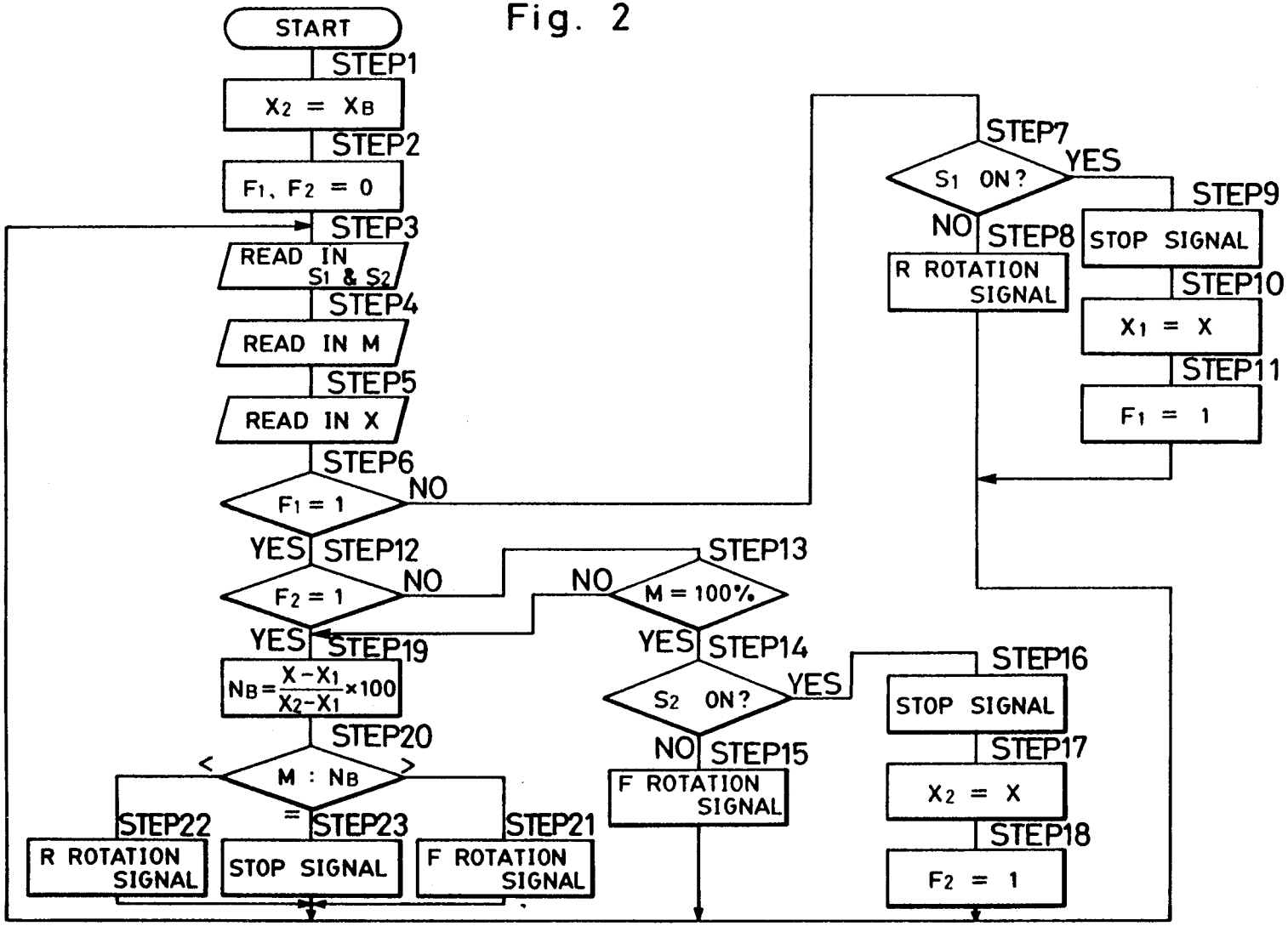
FIG. 2 is a flow chart of the prime mover rotational speed control system of the present invention.
Figure 3:
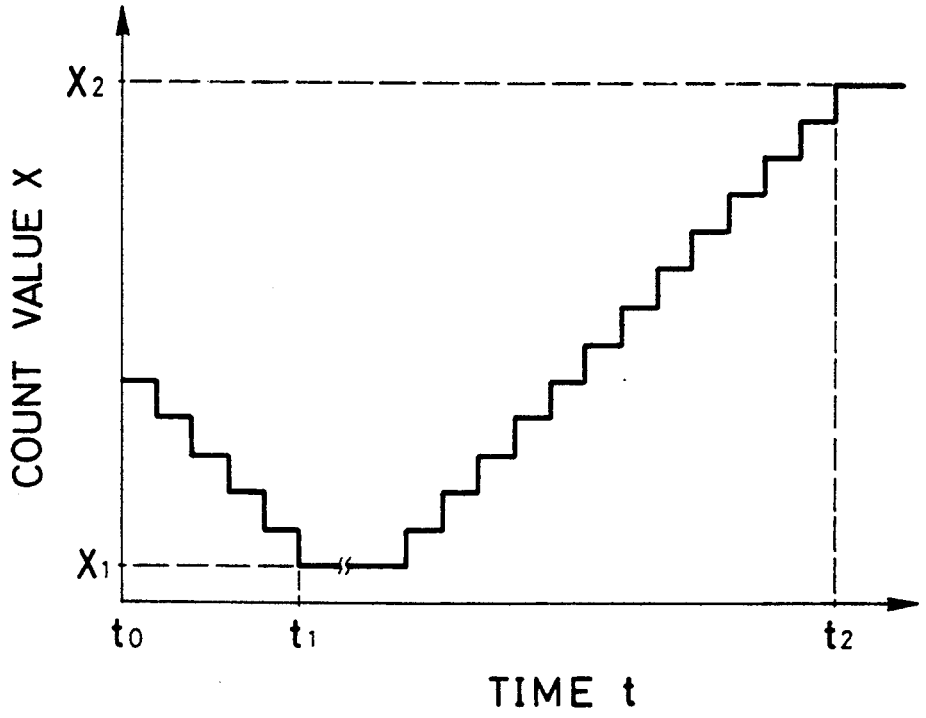
FIG. 3 is a graphical illustration of conditions of a count value from a pulse counter in the rotational speed control system of the present invention.

Referring to FIGS. 1 to 3, in accordance with a first embodiment of the invention, lever position sensor switches 11, 12, in the form of limit switches are located in the vicinity of a governor lever 3 corresponding to stoppers 4 and 5. These lever position sensor switches 11 and 12 are connected to a controller 13 described more fully hereinbelow. The lever position sensor switch 11 is actuated when the governor lever 3 is turned to a minimum speed position, with the lever 3 abutting the stopper 4. The lever position sensor switch 12 is actuated when the governor lever 3 is turned to a maximum speed position, with the lever 3 abutting against the stopper 5. With the governor lever 3 abutting the stopper 4, 5, the sensor switches 11, 12 repectively send the controller 13 a signal that the governor lever 3 has reached the minimum speed position (rotational value $N_B=0\%$) or the maximum speed position (rotational value $N_B=100\%$).

Figure 13:
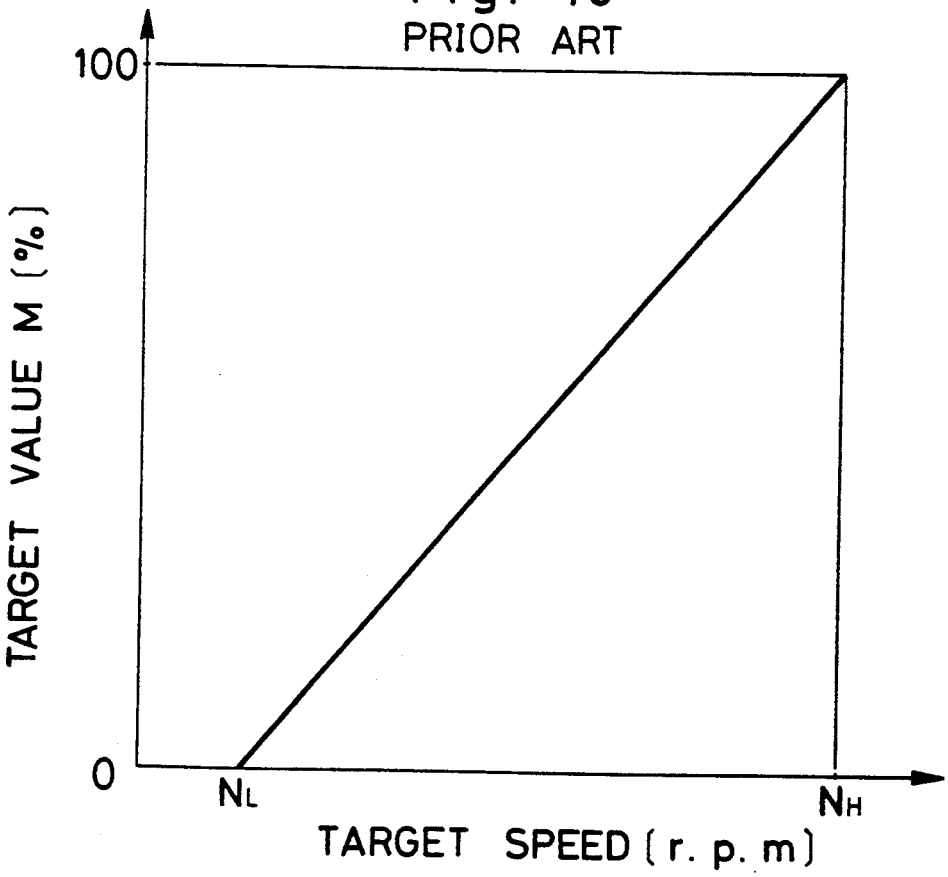
Fig. 13 PRIOR ART
FIG. 13 is a graphical illustration of a relationship between a target value and a target rotational speed stored in a memory area of the controller.

A controller 13 is provided in the operator's cabin (not shown) and includes, similarly to the afore-mentioned prior art controller 10, by an arithmetic processing circuit such as CPU and a memory circuit including ROM (not shown), RAM (not shown) or the like. The controller 13 is provided with a memory area 13A in the memory circuit, storing therein a map as shown in FIG. 13. The memory circuit of the controller 13 also stores therein a program as shown in FIG. 2. Upon receiving a command signal from the up-down switch 9, the controller 13 converts the command signal into a percentage target value M with reference to the map in the memory area 13A to set up, on the basis of the command signal, a target value M which corresponds to the target rotational speed of the engine 1. Then, from a count value X of the pulse counter 14, which will be described hereinafter, and the minimum and maximum reference values $X_1$ and $X_2$, the controller 13 calculates a percentage rotational value $N_B$ of the governor lever 3 corresponding to the current rotational speed, comparing the target value M with the rotational value $N_B$ and accordingly controlling the rotational speed of the engine 1 through adjustment of the stepping motor 6.

A pulse counter 14 serves as the pulse counter means, with the pulse counter 14 being adapted to add and store an added number of control signals upon application of a forward rotational signal to the stepping motor 6 from the controller 13, and to subtract pulses and store a subtracted number of control pulses upon application of a reverse rotational signal.

The prime mover rotational speed control system with the above-described construction according to the invention is similar in basic operation to the above described prior art system.

A reference is now made to FIG. 2 to explain a rotational speed control process which is performed by the controller 13 for the engine 1.

Firstly, upon starting the processing operation, a previously stored backup value $X_B$ is set for the maximum speed reference value $X_2$ in the memory area of the controller 13 in Step 1, followed by flag initialization in Step 2, resetting a flag $F_1$ which stands as $F_1=1$ when a count value X from the pulse counter 14 is set in the minimum speed reference value $X_1$ and a flag $F_2$ which stands as $F_2=1$ when a count value X is set in the maximum speed reference value $X_2$. In next Step 3, detection signals $S_1$ and $S_2$ are read in from the respective lever position sensor switches 11 and 12, followed by Step 4 reading in a preset target value M corresponding to a command signal from the up-down switch 9 and Step 5 of reading in a count value X (a count value at the end of a previous engine operation when freshly starting the processing operation) from the pulse counter 14 at time t (which is $t_0$ when starting the processing operation) as shown in FIG. 3.

Step 6 makes a checkup to see if the flag $F_1$ is set to stand as $F_1=1$, namely, to see if the minimum speed reference value $X_1$ is set. In this instance, since the flag $F_1$ has been reset in Step 2, the result of judgement in Step 6 is "NO" and the processing goes to Step 7 to see if the position sensor 11 is actuated (on). If the result of judgement in Step 7 is "NO", which means that the governor lever 3 has not reached the minimum speed position, a reverse rotation signal is produced for the stepping motor 6 in Step 8, thereafter returning to Step 3 and turning the governor lever 3 in the decelerating direction L until the lever position sensor switch 11 is actuated.

If the result of judgement in Step 7 is "YES", which means that the governor lever 3 is at the minimum speed position (rotational value $N_B=0\%$) abutting against the stopper 4, a stop signal is produced for the stepping motor 6 in Step 9 to stop the lever rotation, thereby preventing damage to the governor lever 3 and retaining same at that rotational angle. In Step 10, a count value X of the pulse counter 14 at that time point $t_1$ (FIG. 3) is stored as the minimum speed reference value $X_1$, setting the flag $F_1$ to stand as $F_1=1$ in Step 11 and continuing the operations of Step 3 and afterwards.

In case the flag $F_1$ is set, that is, if the result of judgement in Step 6 is "YES", the processing proceeds to Step 12 to see if the flag $F_2$ is set to stand as $F_2=1$. In this instance, since the flag $F_2$ was reset in Step 2, the result of judgement in Step 12 is "NO" and the processing goes to Step 13 to see if the target value M has reached the maximum rotational speed $N_H$ ($M=100\%$) as shown in FIG. 13. If the result of judgement in Step 13 is "NO", the current backup value $X_B$ is left to stand as the maximum speed reference value $X_2$ and the processing goes to Step 19 for control of the stepping motor 6 as will be described hereinbelow.

If the result of judgement in Step 13 is "YES", which means that the target value M has reached the value of $M=100\%$, processing proceeds to Step 14 to see if the position sensor switch 12 is on. When the result of judgement in Step 14 is "NO", which means that the governor lever 3 has not reached the maximum speed position, the processing goes to Step 15 to produce a forward rotation signal for the stepping motor 6 and returns to Step 3 to rotate the governor lever 3 in the accelerating direction H until the lever position sensor switch 12 is actuated.

If the result of judgement in Step 14 is "YES", which means that the governor lever 3 has reached the maximum speed position abutting against the stopper 5, a stop signal is produced in Step 16 to stop the lever rotation, thereby preventing damage to the governor lever 13 and maintaining same at that rotational angle. The processing then goes to Step 17 to store a count value X of the pulse counter 14 at that time point $t_2$ as a new maximum speed reference value $X_2$, in FIG. 3, setting the flag $F_2$ to stand as $F_2=1$ in Step 18 before returning to Step 3.

On the other hand, if the flag $F_2$ is found to be set by an affirmative result "YES" in Step 12 or if the target value M is found to have not yet reached the maximum rotational speed $N_H$ (M=100%) by a negative result "NO" in Step 13, the processing goes to Step 19 to calculate the rotational value $N_B$ of the governor lever 3 corresponding to the current rotational speed of the engine 1, on the basis of the minimum and maximum speed reference values $X_1$ and $X_2$ and a current count value X of the pulse counter 14, in accordance with the following equation:

$$N_B = \frac{X - X_1}{X_2 - X_1} \times 100 \quad (1)$$

The processing then goes to Step 20 to determine the deviation of the governor lever rotational value $N_B$ from the target value M. If the current rotational value $N_B$ is found to be less than the target value M in Step 20, the processing goes to Step 21 to produce a forward rotation signal for the stepping motor 6 to turn the governor lever 3 in the accelerating direction H, and returns to Step 3. If the rotational value $N_B$ is found to be greater than the target value M in Step 20, the operation goes to Step 22 to produce a reverse rotation signal for the stepping motor 6, turning the governor lever 3 in the decelerating direction L, and returns to Step 3. In case the rotational value $N_B$ is found to be substantially equal to the target value M in Step 2, the operation proceeds to Step 23 to produce a stop signal for the stepping motor 6, thereby maintaining the governor lever 3 at the current rotational value $N_B$ to operate the engine 1 constantly at the speed.

After the minimum and maximum speed values $X_1$ and $X_2$ are set in the above-described manner, a cycle of Step 3→Step 4→Step 5→Step 6→Step 12→Step 19→Step 20→Step 21, Step 22, Step 23 is repeated to effect an ordinary servo control.

Thus, according to the present embodiment, the lower limit value (the minimum speed position) and the upper limit value (the maximum speed position) of the rotational range of the governor lever 3 are detected by the position sensors 11 and 12, respectively, storing the count value of the pulse counter 14 as minimum and maximum speed reference values $X_1$ and $X_2$ when the governor lever 3 is at the minimum speed position (where the rotational value $N_B$=0%) and the maximum speed position (where the rotational speed $N_B$3'100%), calculating the rotational value $N_B$ of the governor lever 3 as a percentage value corresponding to the rotational speed of the engine 1, from the respective reference values $X_1$ and $X_2$ and the current count value X of the pulse counter 14, and adjusting the stepping motor in dependence upon the deviation of the rotational value $N_B$ from the target value M for the control of the rotational speed of the engine 1.

Therefore, according to the embodiment of FIGS. 1-3, the rotational range of the governor lever 3 is automatically adjusted to coincide with the counting range of the pulse counter 14, thereby avoiding the need for the potentiometer 8 as described hereinabove in connection with the prior art. This contributes to simplifying the initial adjustments to a marked degree, while eliminating the adverse effects of the variations in output characteristics as well as the influences of noises to which the potentiometer 8 is very likely to be subjected. Since the automatic adjustment is effected on every start of the engine 1, it becomes possible to prevent development of a discrepancy between the rotational range of the governor lever 3 and the counting range of the pulse counter 14 in a reliable manner even in case the governor lever 3, link 7 or other parts are subjected to mechanical wear as a result of repeated use over an extended period of time, thereby permitting to stably and accurately control the rotational speed of the engine 1 over a long time period with markedly improved reliability.

Figure 4:
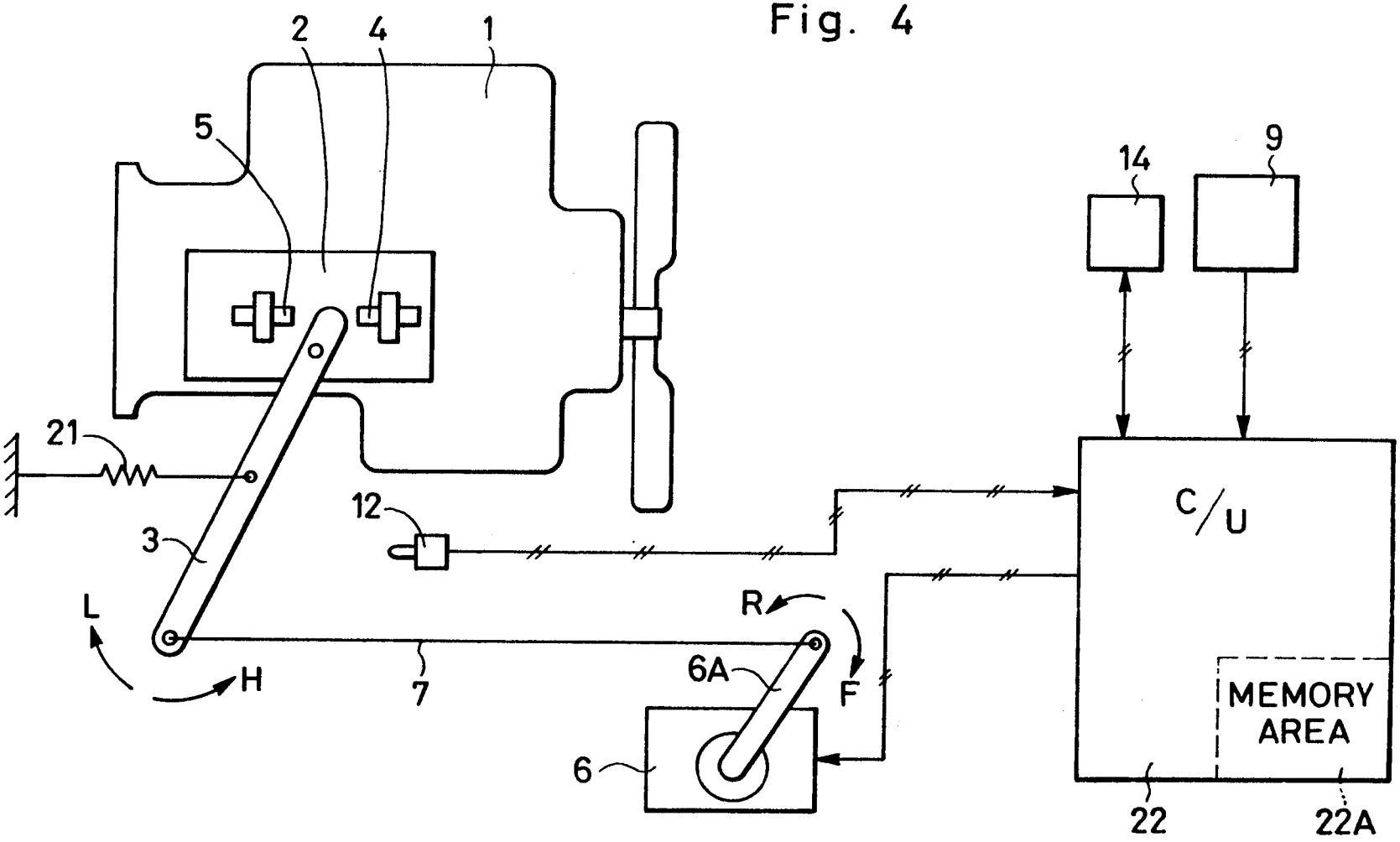
FIG. 4 is a schematic view of a general arrangement of a prime mover rotational speed control system constructed in accordance with a second embodiment of the present invention.
Figure 5:
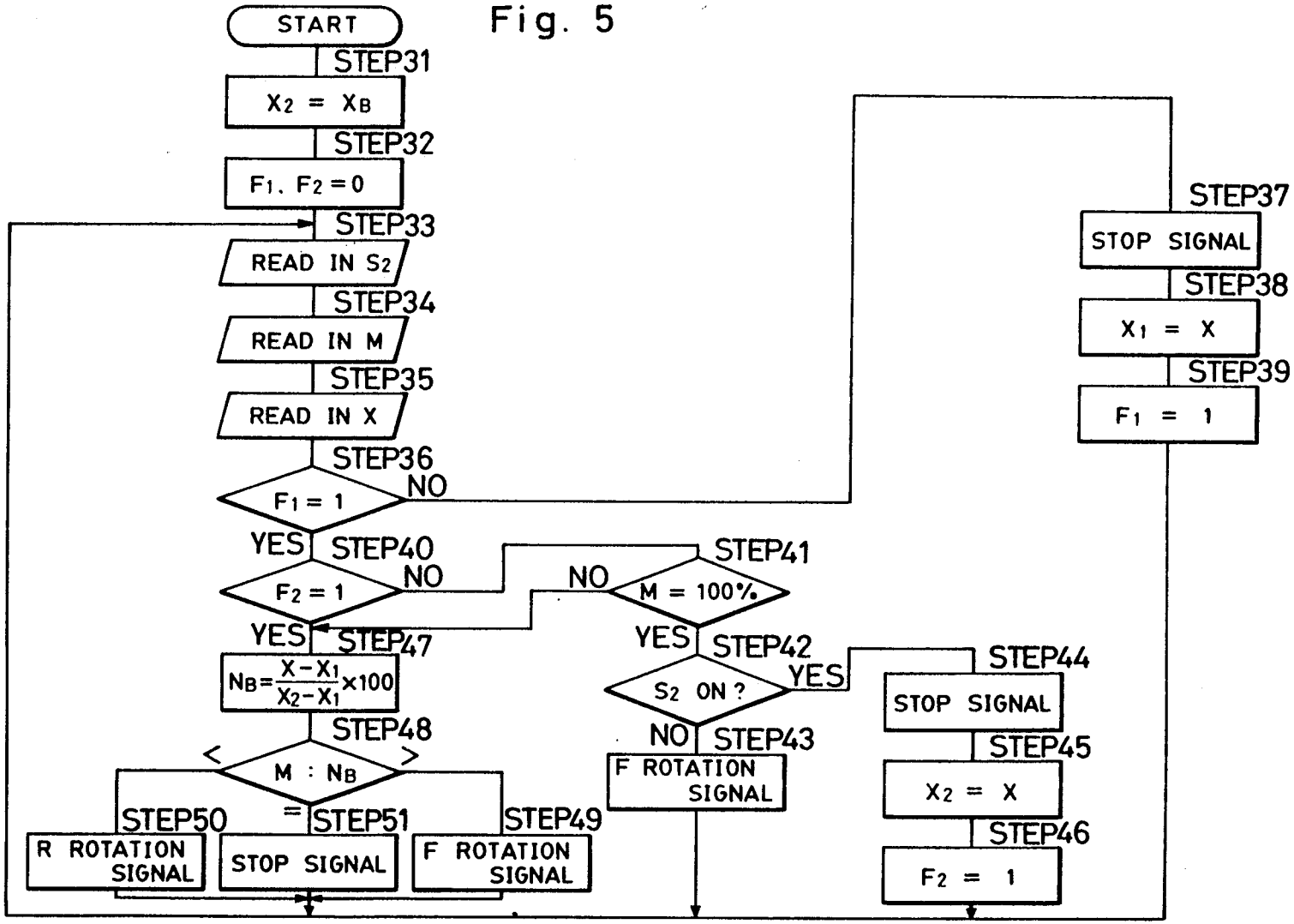
FIG. 5 is a flow chart of a prime mover rotational speed control of the rotational speed control system of the second embodiment.
Figure 6:
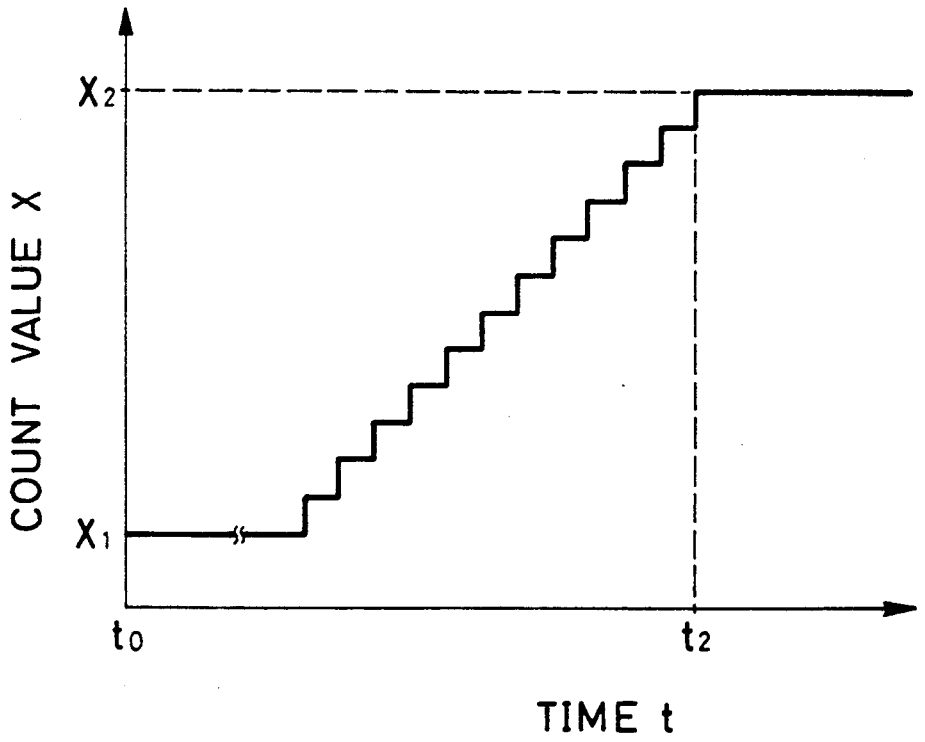
FIG. 6 is a graphical illustration of conditions of a count value from a pulse counter in the rotational speed control system of the second embodiment of the present invention.

In the second embodiment of FIGS. 4 to 6, a tension spring pulls the governor lever 3 toward the minimum speed position when the engine is at rest, and the lever position sensor switch provided on the side of the minimum speed position in the embodiment of FIGS. 1-3 is eliminated.

More particularly, as shown in FIG. 4, a tension spring 21 in the form of a coil spring is provided in the vicinity of the engine 1. The coil spring 21 is supported at its base end by a support member, not shown, and has a front end connected to the governor lever 3. The coil spring 21 constantly urges the governor lever 3 toward the minimum speed position, so that the governor lever 3 abuts against the stopper 4 when the engine 1 is turned off and the stepping motor 6 is de-energized, namely, when there is no holding torque any more.

Indicated at 22 is a controller which is arranged substantially in the same manner as the controller 13 of the above-described first embodiment. The controller 22 is provided with a memory area 22A in the memory circuit to store the map of FIG. 13. Besides, a program as shown in FIG. 5, for example, is stored in the memory circuit to thereby control the rotational speed of the engine 1.

Now, the rotational speed control of the embodiment of FIGS. 4-6 is explained with reference to FIG. 5.

Firstly, upon starting the processing operation, a previously stored backup value $X_B$ is set as the maximum reference value $X_2$ in the memory area 22A of the controller 22 in Step 31, followed by flag initialization in Step 32 resetting flags $F_1$ and $F_2$. Next, the processing goes to Step 33 to read in a detection signal $S_2$ from the lever position sensor switch 12, and to Step 34 to read in a target value M which has been determined on the basis of a command signal from the up-down switch 9, reading in a count value X from the pulse counter 14 at time t as shown in FIG. 6.

The processing then goes to Step 36 to ascertain if the flag $F_1$ is set to stand as $F_1=1$, which means that the minimum reference value $X_1$ is set. Since the flag $F_1$ was reset in Step 32, the result of judgement in Step 36 is "NO", and the processing proceeds to Step 37 to produce a stop signal for the stepping motor 6 to stop its rotation because the governor lever 3 is held in the minimum speed position under the influence of the biasing force of the spring 21, thus preventing damages to the governor lever 3 and maintaining its current rotational angle. A count value X at that time point is stored as the minimum speed reference value $X_1$ in Step 38, setting the flag $F_1$ to stand as $F_1=1$ in Step 39 and continuing the processing of Step 33 and afterwards.

When the flag $F_1$ is set and the result of judgement in Step 36 is "YES", the processing goes to Step 40 to see if the flag $F_2$ is set. In this instance, since the flag $F_2$ was reset in Step 32, the result of judgement in Step 40 is "NO" and the processing proceeds to Step 41 to see whether or not the target value M has reached the maximum rotational speed $N_H$ (M=100%). If the result of judgement in Step 41 is "NO", the processing then goes to Step 47 for the control of the stepping motor 6, leaving the previously set backup value $X_B$ to stand as the maximum speed reference value $X_2$.

When the results of judgement in Step 41 is "YES", that is to say, when the target value M is found to have reached the maximum rotational speed $N_H$, the processing proceeds to Step 42 to see if the position sensor 12 is on. In case the result of judgement in Step 42 is "NO", which means that the governor lever 3 has not reached the maximum speed position, the processing goes to step 43 to produce a forward rotation signal for the stepping motor 6 and then returns to Step 33 to rotate the governor lever 3 in the accelerating direction H until the lever position sensor switch 12 is actuated.

If the result of judgement in Step 42 is "YES", which means that the governor lever 3 is in the maximum rotational speed position, that is, in abutting engagement with the stopper 5, the processing goes to Step 44 to produce a stop signal for the stepping motor 6 to stop the governor lever rotation, thereby preventing damage to the governor lever 3 and maintaining the same at that rotational angle. In Step 45, the maximum speed reference value $X_2$ is renewed with a count value X of the pulse counter 14 at time $t_2$ as shown in FIG. 6. The flag $F_2$ is set to stand as $F_2=1$ in Step 46 before returning to Step 33.

On the other hand, when the result of judgement in Step 40 is "YES", which means that the flag $F_2$ is set, or when the result of judgement in Step 41 is "NO", which means that the target value M has not yet reached the maximum rotational speed $N_H$, processing goes to Step 47 to determine the rotational value $N_B$ of the governor lever 3, corresponding to the current rotational speed of the engine 1, from the minimum speed reference value $X_1$, maximum speed reference value $X_2$ and a current count value X of the pulse counter according to Equation (1).

Next, the processing goes to Step 48 to see if there is a deviation between the target value M and the rotational value $N_B$ of the governor lever 3, which are both expressed in percentage. If the current rotational value $N_B$ of the governor lever 3 is less than the target value M, the processing goes to Step 49 to produce a forward rotation signal for the stepping motor 6 to turn the governor lever 3 in the accelerating direction H, and then returns to Step 33. When the rotational value $N_B$ is found to be greater than the target value M in Step 48, the processing goes to Step 50 to produce a reverse rotation signal for the stepping motor 6 to turn the governor lever 3 in the decelerating direction L, and then returns to Step 33. When the rotational value $N_B$ is found to be substantially equal to the target value M in Step 48, the processing proceeds to Step 51 to produce a stop signal for the stepping motor 6, maintaining the governor lever 3 at the current rotational angle to constantly operate the engine 1 at that speed.

After the minimum and maximum speed reference values $X_1$ and $X_2$ are set in the above-described manner, the processing repeats the cycle of Step 33→Step 34→Step 35→Step 36→Step 40→Step 47→Step 48→Step 49, Step 50, Step 51 for an ordinary servo control.

Thus, in addition to the operational effects substantially similar to those of the first embodiment, the second embodiment with the above-described arrangement, including the spring 21 which urges the governor lever 3 constantly toward the minimum speed position, permits the elimination of the lever position sensor switch 11 provided in the embodiment of FIGS. 1-3 to detect location of the governor lever 3 in the minimum speed position, and therefore contributes to a reduction in the production cost of the prime mover speed control system.

In the embodiment of FIGS. 7 to 10, a torque limiter 32 is provided within the length of the link in place of the lever position sensor switches in the embodiment of FIGS. 1-3.

Figure 7:
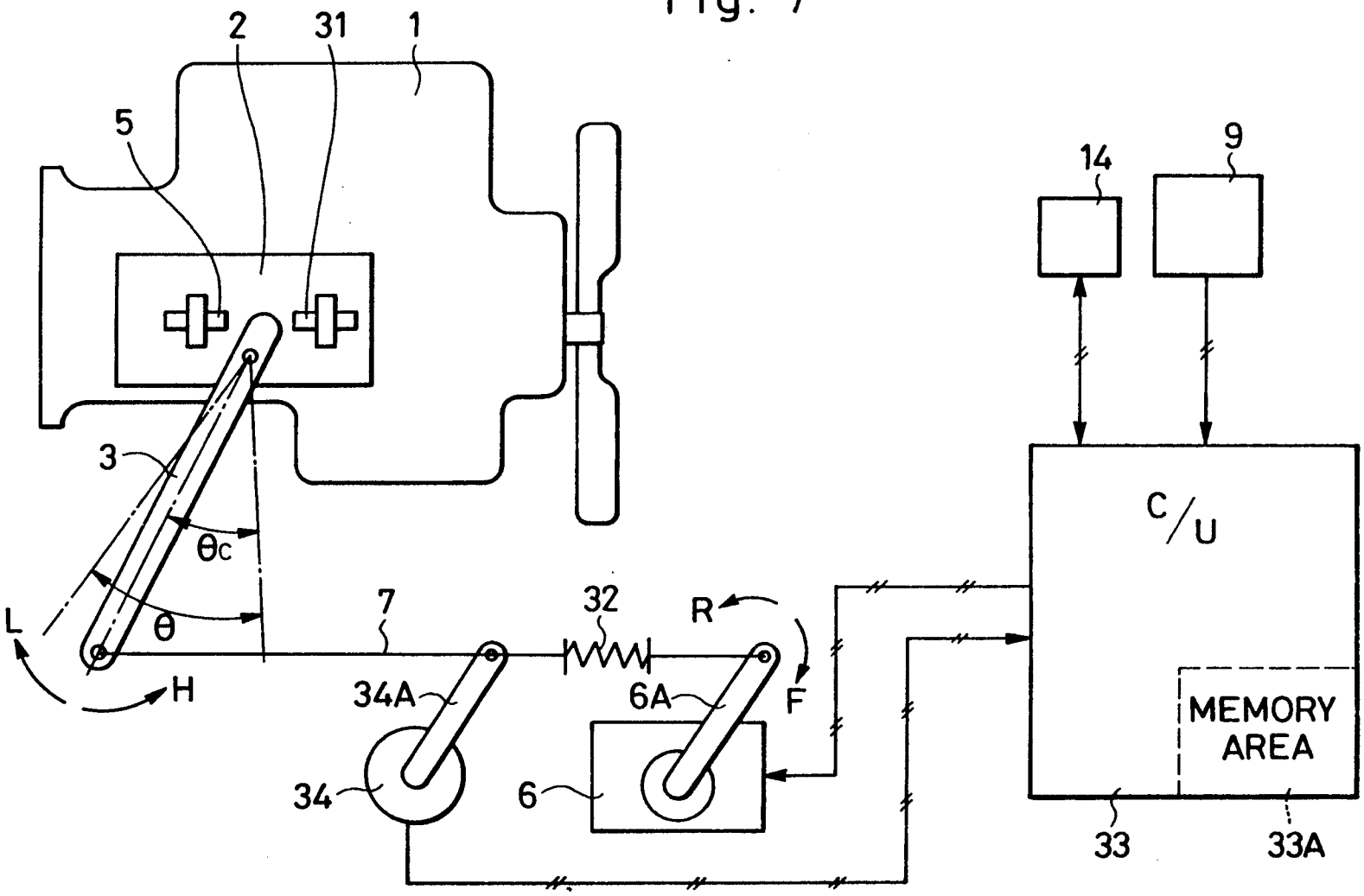
FIG. 7, is a schematic view of a general arrangement of a prime mover rotational speed control system constructed in accordance with a further embodiment of the present invention.

In FIGS. 7-10, a stopper 31, similar in construction to the stopper 4 of the prior art is arranged so as to abut against the governor lever 3 to delimit the rotational range thereof. In this instance, however, it is located in such a position that the rotation of the engine 1 is stopped as soon as the governor lever 3 comes into abutting engagement with the stopper 31. Namely, as shown in FIG. 7, the stopper 31 limits the rotation of the governor lever 3 in the accelerating and decelerating directions H and L to a rotational range $\theta$ in cooperation with the stopper 5. When the governor lever 3 abuts against the stopper 31, the rotational speed of the engine 1 is substantially reached to zero to stop its rotation. When abutted against the stopper 5, the rotational speed of the engine 1 is increased to the maximum speed $N_H$. From the minimum speed position for the minimum rotational speed $N_L$, which is indicated by solid line in FIG. 7, the governor lever 3 is rotatable until it is abutted against the stopper 5, adjusting the rotational speed of the engine 1 within a control range $\theta_C$.

The torque limiter 32 is inserted in the link 7 at a position between the lever 6A of the stepping motor 6 and a lever 34A of a potentiometer 34 which will be described more fully hereinbelow. For example, the torque limiter 32 includes a coil spring or the like and acts as a rigid body when the stepping motor 6 is turned in the forward direction F or reverse direction R, for transmitting the rotation of the stepping motor 6 to the governor lever 3 through the link 7, and acts as a buffer when the governor lever 3 abuts against the stopper 31 or 5, preventing damages to the governor lever 3 which might be caused by overmuch rotation of the stepping motor 6.

Figure 8:
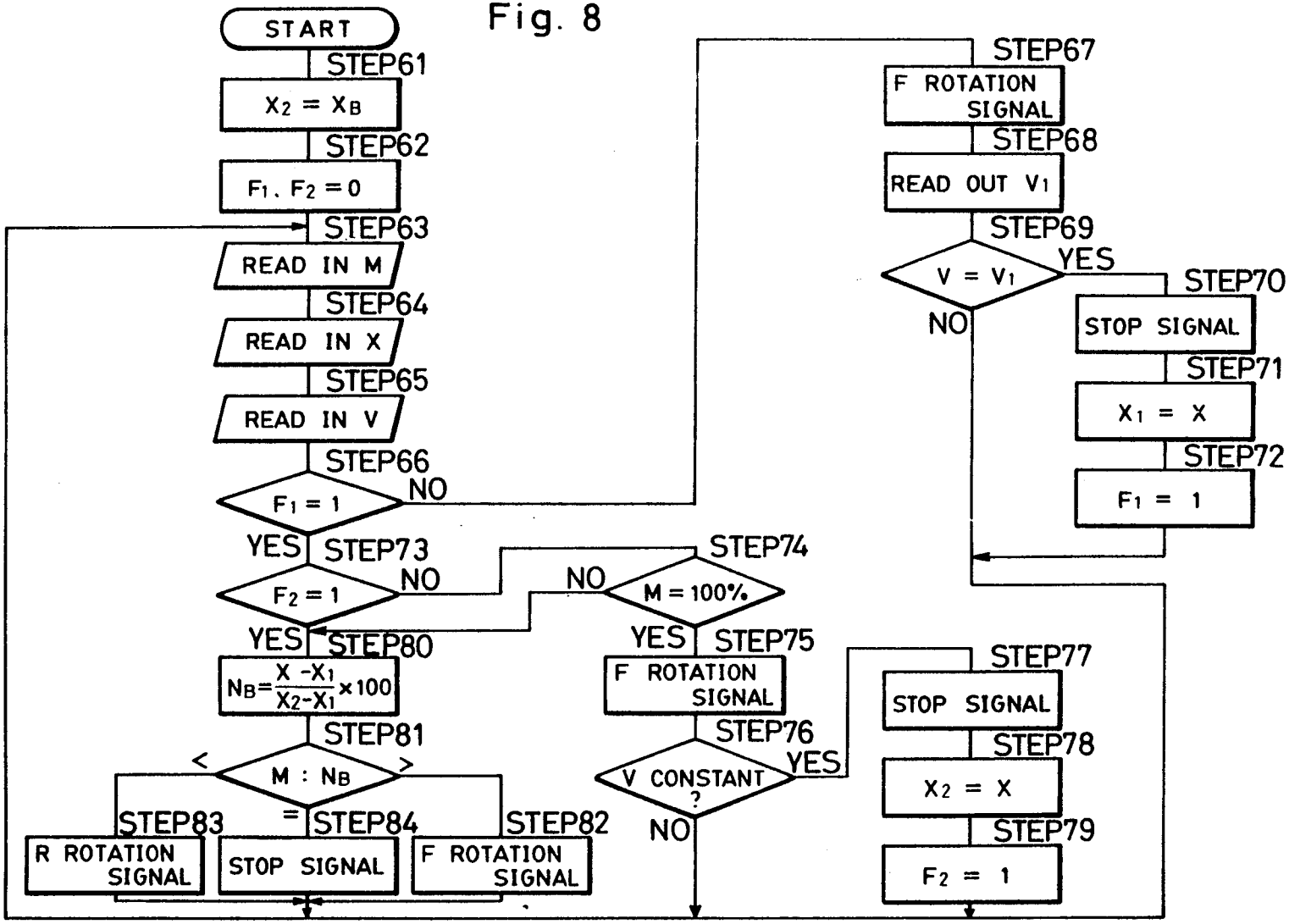
FIG. 8 is a flow chart of a prime mover rotational speed control of the further embodiment of the present invention.

A controller 33, which is substantially same in construction as the controllers 13 and 32 of the embodiments of FIGS. 1-6, includes a memory area 32A in its memory circuit to store the map of FIG. 13 along with a predetermined value $V_1$ which will be described hereinlater. In the embodiment of FIGS. 7-10, a program as shown in FIG. 8 is stored in the memory circuit of the controller 32 to control the rotational speed of the engine 1. Upon stopping the engine 1, the controller 32 rotates the stepping motor 6 in the reverse direction R thereby resulting in the governor lever 3 abutting against the stopper 31.

Figure 9:
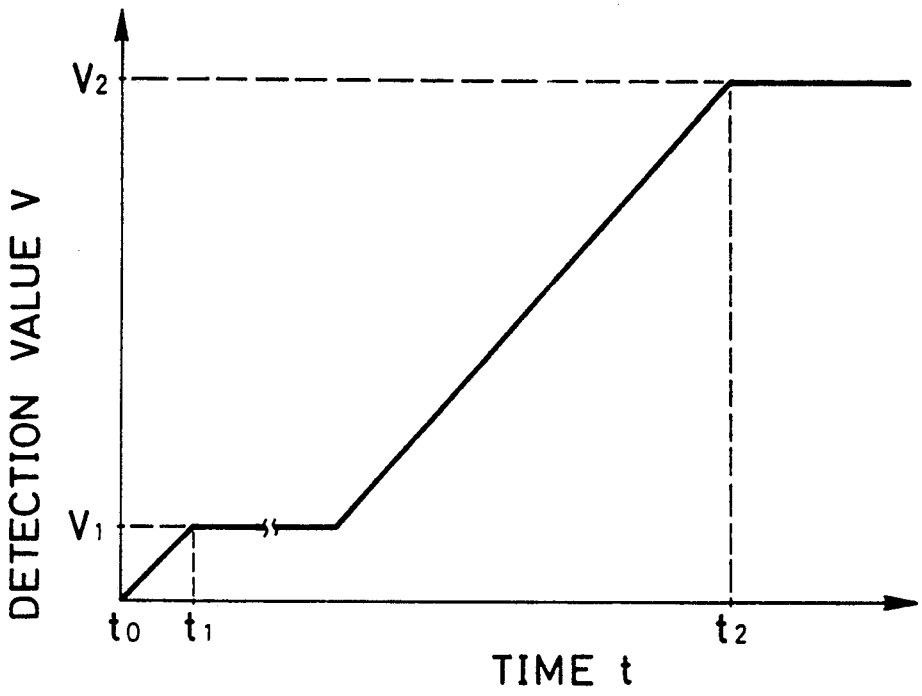
FIG. 9 is a graphical illustration of conditions of a detected value of a potentiometer.

A potentiometer 34 serves as a rotational angle sensor means for detecting the rotational angle of the governor lever 3 through the link 7. The potentiometer 34 is arranged substantially in the same manner as the potentiometer 8 of the prior art in general construction, including a lever 34A. In this instance, however, the potentiometer 34 is preadjusted such that, when the governor lever 3 is turned to the minimum speed position of FIG. 7 at time $t_1$, as shown in FIG. 9, for example, its detection value V takes a value corresponding to the predetermined value $V_1$ stored in the memory area 33A of the controller 33.

A description on the rotational speed control by this embodiment is given below with reference to FIG. 8.

Firstly, upon starting the processing operation, a previously stored backup value $X_B$ in the memory area 33A of the controller 33 is set as the maximum speed reference value $X_2$ in Step 61, which is followed by Step 62 of resetting flags $F_1$ and $F_2$, Step 63 of reading in a target value M, Step 64 of reading in a count value from the pulse counter 14, and Step 65 of reading in a detection value V from the potentiometer 34.

The processing then goes to Step 66 to ascertain whether or not the flag $F_1$ is set to stand as $F_1=1$. In this instance, the flag $F_1$ was reset in Step 62 so that the result of judgement in Step 66 is "NO" and the processing proceeds to Step 67. In Step 67, since the governor lever 6 abuts against the stopper 31 at time $t_0$ as shown in FIG. 9, a forward rotation signal is produced for the stepping motor 6, turning the governor lever 3 in the accelerating direction H until the result of judgement in Step 69 becomes affirmative.

Figure 10:
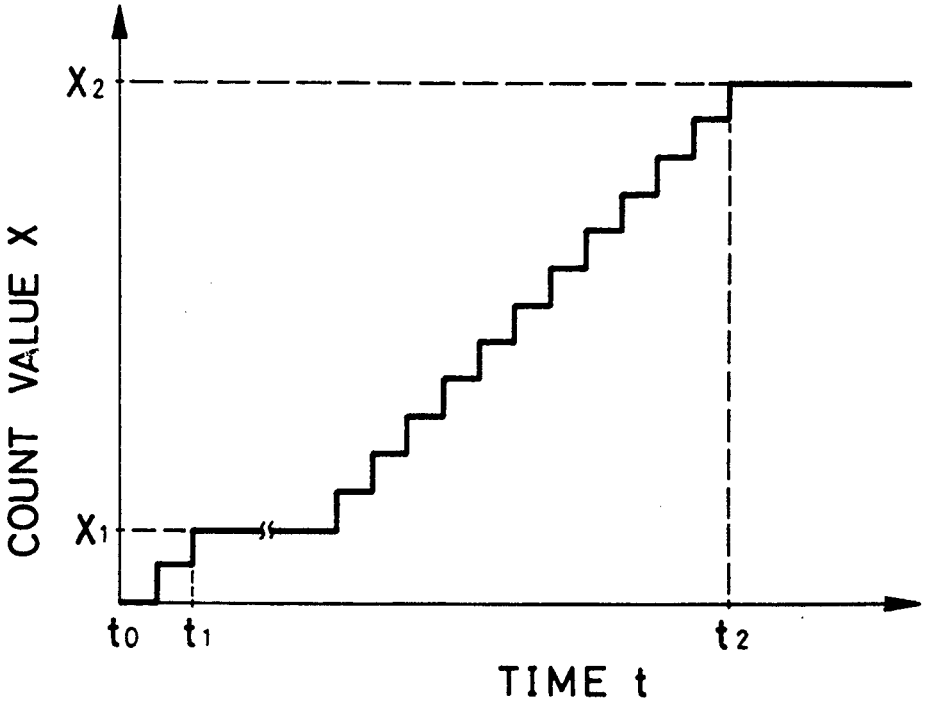
FIG. 10 is a graphical illustration of conditions of count value from pulse counter.
Figure 11:
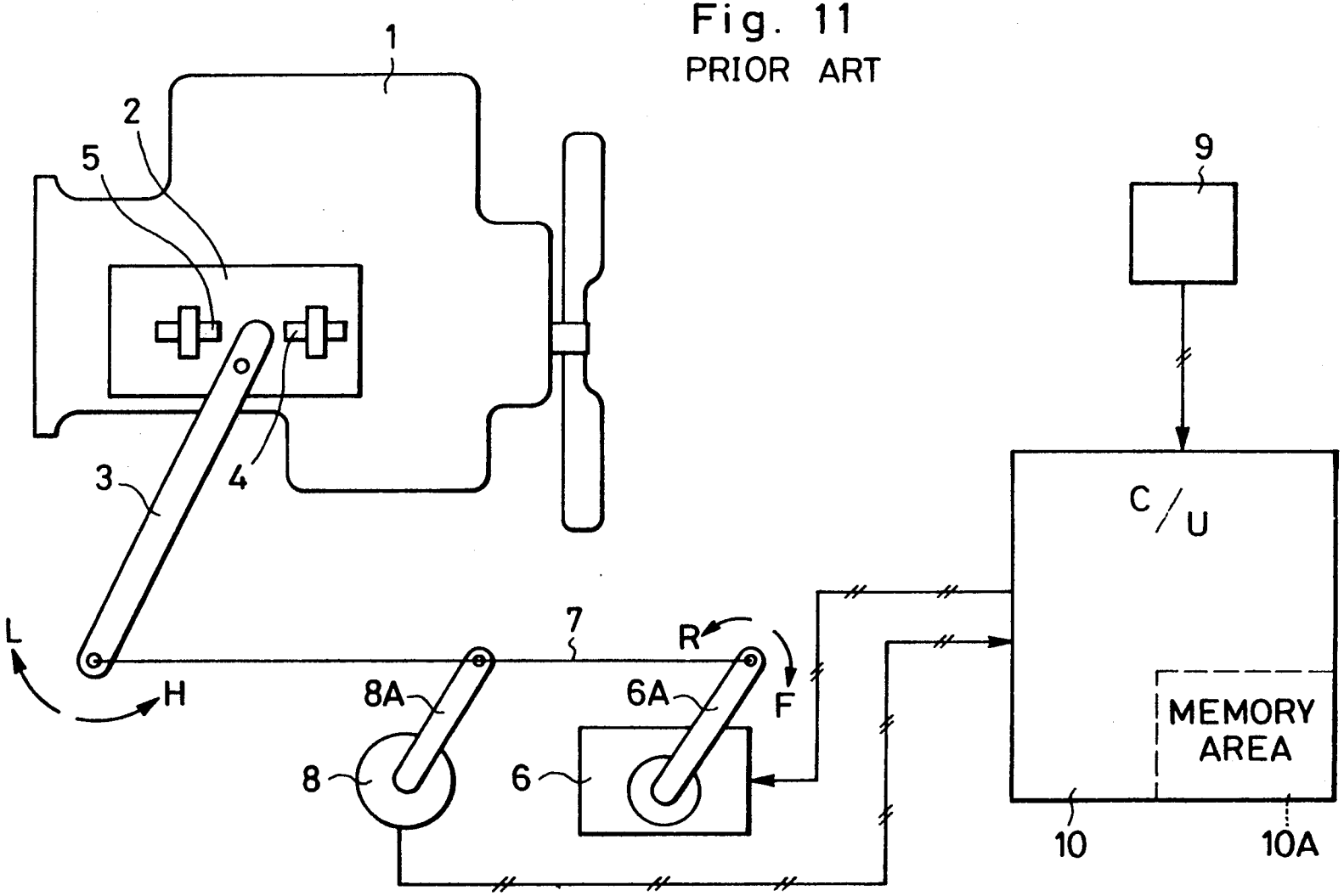
Fig. 11 PRIOR ART
FIG. 11 is a schematic view of a prior art prime mover rotational speed control system.
Figure 12:
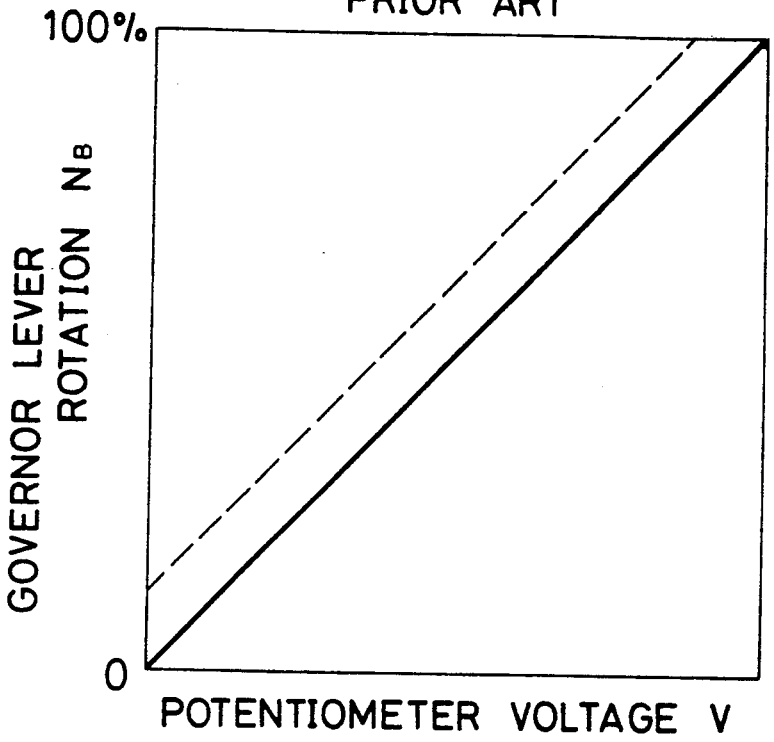
Fig. 12 PRIOR ART
FIG. 12, is a graphical illustration of the relationship between the value detected by a potentiometer and the rotational angle of the governor lever.

Next, the predetermined value $V_1$ which was stored in the memory area 33A in the stage of preadjustment of the rotational speed control system, is read out in Step 68, followed by Step 69 checking up whether or not the detection value V from the potentiometer has reached a value substantially equal to the predetermined value $V_1$. If the result of judgement in Step 69 is "YES", which means that the governor lever 3 is in the minimum speed position indicated by solid line in FIG. 7, a stop signal is produced for the stepping motor 6 in Step 70 to stop rotation of the lever, thereby retaining the governor lever 3 at the current rotational angle. The processing then goes to Step 71 to store a count value X of the pulse counter 14 at time $t_1$, as shown in FIG. 10, as the minimum speed reference value $X_1$, and to Step 72 to set the flag $F_1$ to stand as $F_1=1$, before returning to Step 63.

On the other hand, when the flag $F_1$ has been set and the result of judgement of Step 66 is "YES", the processing proceeds to Step 73 to see whether or not the flag $F_2$ is set. In this instance, the flag $F_2$ was reset in Step 62, so that the result of judgement in Step 73 is "NO" and the processing goes to Step 74 to ascertain whether or not the target value M has reached the level of M=100% (see FIG. 13) which corresponds to the maximum rotational speed $N_H$. If the result of judgement in Step 74 is "NO", the processing goes to Step 80 for controlling the stepping motor 6 as will be described hereinbelow leaving the current backup value $X_B$ to stand as the maximum speed reference value $X_2$.

When the result of judgement in Step 74 is "YES", which means that the target value M has reached the level of M=100%, the processing goes to Step 75 to produce a forward rotation signal to turn the governor lever 3 in the accelerating direction H until the result of next Step 76 becomes affirmative. Step 76 checks up whether or not the detection value V from the potentiometer 34 has become constant. If the result of judgement in Step 76 is "YES", which means that the governor lever 3 is in the maximum speed position in abutting engagement with the stopper 5 and the detection value V from the potentiometer 34 has become constant by actuation of the torque limiter 32, the processing goes to Step 77 to produce a stop signal for the stepping motor 6 thereby stopping the lever rotation and retaining the governor lever 3 at that rotational angle, and then to Step 78 to renew the maximum speed reference value $X_2$ with a count value X read in from the pulse counter 14 at that time point $t_2$ (FIG. 10), setting the flag $F_2$ to stand as $F_2=1$ in Step 79 before returning to Step 63.

On the other hand, in case the result of judgement in Step 73 is "YES", which means that the flag $F_2$ is set, or in case the result of judgement in Step 74 is "NO", which means that the target value M has not reached the level of M=100%, the processing goes to Step 80 to determine the rotational value $N_B$ of the governor lever corresponding to the current rotational speed of the engine 1 according to Equation (1) on the basis of the minimum speed reference value $X_1$, maximum speed reference value $X_2$ and current count value X of the pulse counter 14.

Next, the processing goes to Step 81 to see if there is a deviation between the rotational value N of the governor lever 3 and the target value M, and, if the rotational value $N_B$ is found to be less than the target value M, goes to Step 82 to produce a forward rotation signal for the stepping motor 6. In case the current rotational value $N_B$ is found to be greater than the target value M, the processing goes to Step 83 to produce a reverse rotation signal for the stepping motor 6. When the rotational value $N_B$ is found to be substantially equal with the target value M, the processing proceeds to Step 84 to produce a stop signal for the stepping motor 6, retaining the governor lever 3 at the current rotational angle to operate the engine 1 at that speed.

After the minimum speed reference value $X_1$ and maximum speed reference value $X_2$ are set, a cycle of Step 63→Step 64→Step 65→Step 66→Step 73'→Step 80→Step 81→Step 82, Step 83, Step 84 is repeated to effect an ordinary servo control.

In addition to the operational effects similar to those in the embodiments of FIGS. 1-3 and 4-6, the embodiment of FIGS. 7-10 with the above-described arrangement, including the torque limiter 32 inserted within the length of the link 7, can prevent damage to the governor lever 3 or other components even when the governor lever 3 is pressed against the stopper 5 by forward rotation of the stepping motor 6 in the direction of arrow F, without the provision of the lever position sensor switches 11 and 12 as in the embodiment of FIGS. 1-3, setting both of the minimum speed reference value $X_1$ and the maximum speed reference value $X_2$ upon each start of the engine 1 to ensure accurate control of rotational speed of the engine 1.

In the foregoing embodiments, the arithmetic operating means is embodied into Steps 19, 47 and 80 of the programs of FIGS. 2, 5 and 8, and the memory means is embodied into Steps 10, 17, 38, 45, 71 and 78.

The pulse counter 14 which serves as a pulse counting means is provided outside the controller 13, 22 or 33 in the foregoing embodiments. However, according to the present invention, the controller is not restricted to such an arrangement and may be arranged to include a pulse counter if desired.

In place of the up-down switch which is employed in the foregoing embodiments, the command means may include a mode selector switch, a fuel lever or the like.

On the other hand, in the foregoing embodiments, the target value M is converted into a percentage value according to the map of FIG. 13, for comparison with the rotational value $N_B$, a percentage value which is calculated according to Equation (1) on the basis of the minimum sped reference value $X_1$, maximum speed reference value $X_2$ and current count value X. However, for the purpose of comparison, the target value M and rotational value $N_B$ may be expressed by a numerical value of from 0 to 1 if desired.

Further, in place of the limit switches which are employed as the lever position sensor switches 11 and 12 in the embodiment of FIGS. 1–3 to determine both of the minimum speed reference value $X_1$ and the maximum speed reference value $X_2$, approaching switches or other sensor switches may be used as the lever position sensor switches, or alternatively a lever sensor switch may be provided only on the side of the minimum speed position to obtain the minimum speed reference value $X_1$ while setting a backup value $X_B$ for the maximum speed reference value $X_2$.

If desired, the coil spring or tension spring 21, which is employed in the embodiment of FIGS. 4–6 to constantly urge the governor lever 3 toward the minimum rotational speed position, may be replaced by a compression spring which is arranged to bias the governor lever 3 constantly toward the minimum speed position.

Furthermore, in the embodiment of FIGS. 7–10, the location of the governor lever 3 at the maximum speed position is detected by an abutment of the governor lever 3 against the stopper 5 while ascertaining whether or not the detection value V from the potentiometer 34 has become constant in Step 76. Alternatively, approaching switches may be provided for this purpose, for example, on the torque limiter 32 to detect the location of the governor lever 3 at the minimum and maximum speed positions, or a rotary encoder or the like may be used as a rotational angle sensor means.

Moreover, although the embodiment of FIGS. 7–10 is arranged to detect the location of the governor lever 3 at the minimum speed position on the basis of the detection value V from the potentiometer 34, it may alternatively employ, for example, an approaching switch, a limit switch or the like for detection of the governor lever 3 arriving at the minimum speed position.

On the other hand, a biasing spring which constantly urges the governor lever 3 toward the minimum speed position may be provided in the first and third embodiment, or a torque limiter may be provided in the first and second embodiments if desired.

As clear from the foregoing detailed description, the prime mover rotational speed control system according to the invention is provided with, in combination with a pulse counting means for counting the control pulse signals to be applied to the stepping motor, a controller including a memory means arranged to store a count value of the pulse counting means as a renewable reference value when the rotational speed of the prime mover is set at least at one of predetermined minimum and maximum speeds of the prime mover, and an arithmetic operating means arranged to calculate the current rotational speed of the prime mover on the basis of the reference value in the memory means and a count value of the pulse counting means for the current governor lever position. Therefore, when the rotational speed of the prime mover is set at least at either the minimum rotational speed or maximum rotational speed, the rotational angle of the governor lever at that speed is detected from the count value of the pulse counting means while storing the count value in the memory means as a renewable reference value. Consequently, the arithmetic operating means can calculate the rotational angle of the governor lever corresponding to the current rotational speed of the prime mover, from the current count value from the pulse counting means and the reference value, thereby automatically adjusting the rotational range of the governor lever relative to the counting range of the pulse counter means, for example, on each start of the prime mover. This contributes simplification of preadjustment to a considerable degree and ensures stable rotational speed control of the prime mover over a long period of time.

The accuracy and reliability of the prime mover rotational speed control system can be improved all the more by adoption of a more correct rotational speed control which is arranged to store the count values of governor lever at both of the minimum and maximum speeds in the memory means as renewable reference values and to calculate the current rotational speed of the prime mover on the basis of the respective reference values and the count value of the pulse counter means at the current governor lever position by the arithmetic operating means.

What is claimed is:

1. A prime mover rotational speed control system including a prime mover, a governor having a governor lever for increasing or reducing the rotational speed of said prime mover in accordance with a rotational angle of said governor lever, a stepping motor adapted to turn said governor lever in response to a control pulse signal, a command means for specifying a target rotational speed of said prime mover, and a controller means adapted to produce a control pulse signal in dependence upon a specified value from said command means for application to said stepping motor, wherein said rotational speed control system comprises:

a pulse counter means for counting control signal pulses to be applied to said stepping motor; and a controller comprising a memory means adapted to store a count value from said pulse counter means as a renewable reference value when the rotational speed of said prime mover is set at least at one of predetermined minimum and maximum speeds thereof, and an arithmetic operating means adapted to calculate the current rotational speed of said prime mover on the basis of said reference value stored in same memory means and a count value of the pulse counter means at the current position of said governor lever.

2. A prime mover rotational speed control system as defined in claim 1, wherein said memory means is adapted to store a count value from said pulse counter means as renewable minimum or maximum speed reference values when the rotational speed of the prime mover is set at said minimum or maximum speeds, and the arithmetic operating means is adapted to calculate the current rotational speed of said prime mover on the basis of the respective reference value and a count value of said pulse counter means at the current position of said governor lever.

* * * * *